US011668449B2

(12) United States Patent
Go et al.

(10) Patent No.: US 11,668,449 B2
(45) Date of Patent: Jun. 6, 2023

(54) LAMP FOR VEHICLE

(71) Applicant: SL Corporation, Daegu (KR)

(72) Inventors: Dong Hyun Go, Gyeongsan-si (KR); Hyo Jin Han, Gyeongsan-si (KR); Tae Seok Seo, Gyeongsan-si (KR); Joo Jin Chang, Gyeongsan-si (KR); Young Ho Son, Gyeongsan-si (KR); Jun Woo Woo, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/691,197

(22) Filed: Mar. 10, 2022

(65) Prior Publication Data

US 2022/0373154 A1 Nov. 24, 2022

(30) Foreign Application Priority Data

May 18, 2021 (KR) ..... 10-2021-0063948

(51) Int. Cl.

| | |
|---|---|
| ***F21S 41/153*** | (2018.01) |
| ***F21S 41/265*** | (2018.01) |
| ***F21S 43/249*** | (2018.01) |
| ***F21S 45/48*** | (2018.01) |
| ***F21S 43/31*** | (2018.01) |
| ***F21S 43/236*** | (2018.01) |

(52) U.S. Cl.
CPC ..... *F21S 43/249* (2018.01); *F21S 41/153* (2018.01); *F21S 41/265* (2018.01); *F21S 43/236* (2018.01); *F21S 43/31* (2018.01); *F21S 45/48* (2018.01)

(58) Field of Classification Search
CPC ..... F21S 41/153; F21S 41/265
See application file for complete search history.

(56) References Cited

U.S. PATENT DOCUMENTS

2015/0062950 A1* 3/2015 Fedosik ..... F21S 41/265 362/522
2021/0262634 A1* 8/2021 Lim ..... F21S 41/153

* cited by examiner

*Primary Examiner* — Sean P Gramling
(74) *Attorney, Agent, or Firm* — United One Law Group LLC; Kongsik Kim; Jhongwoo Peck

(57) ABSTRACT

A vehicle lamp includes a light source unit including a plurality of light emitting units for forming different beam patterns, and an optical unit disposed in front of the light source unit for transmitting light generated from the light source unit to form a predetermined beam pattern. The plurality of light emitting units includes a first light emitting unit for forming a first beam pattern and a second light emitting unit disposed around the first light emitting unit for forming a second beam pattern different from the first beam pattern.

11 Claims, 13 Drawing Sheets

LAMP FOR VEHICLE

CROSS-REFERENCE TO RELATED APPLICATION

This application claims priority from Korean Application No. 10-2021-0063948 filed on May 18, 2021, which application is incorporated herein by reference in its entirety.

BACKGROUND

1. Technical Field

The present disclosure relates to a vehicle lamp, and more particularly, to a vehicle lamp that prevents unnecessary dark bands from forming in a lit image.

2. Description of the Related Art

Generally, a vehicle is provided with various lamps having purposes of an illumination function for easily identifying an object located around the vehicle in low light conditions (e.g., at night) and a signaling function for notifying drivers of other vehicles or pedestrians of the driving state of the vehicle during the daytime or at night.

For example, head lamps and fog lamps are mainly for the illumination functions, and daytime running lamps (DRL), turn signal lamps, tail lamps, and brake lamps are mainly for the signaling functions. The installation standards and specifications of each lamp are stipulated by law or regulations to ensure that the functions of each lamp are fully implemented.

In recent years, not only the functional aspects of a vehicle lamp, but also the aesthetic aspects that consumers perceive are impacting more and more on the purchase decisions of a vehicle.

To this end, research is being actively conducted to improve the exterior design of a vehicle lamp to have a slimmer shape, and to form an optimal beam pattern while implementing a slim shape using a plurality of lamp modules.

When a vehicle lamp includes a plurality of lamp modules, some of the plurality of lamp modules may be used for different purposes from others. Accordingly, some of the plurality of lamp modules may be turned off when the vehicle operates during the daytime or at night. In this case, there is a possibility that unnecessary dark bands are formed, and an incomplete lit image is formed as a whole.

Accordingly, there is a need for a means to prevent an incomplete lit image from forming due to dark bands generated when some of the plurality of lamp modules are turned off, thereby preventing deterioration of the exterior design.

SUMMARY

An object of the present disclosure is to provide a lamp for a vehicle capable of preventing the exterior design from being deteriorated by irradiating light from an unused lamp module among a plurality of lamp modules to form a complete lit image as a whole when the vehicle operates during the daytime or at night. The objects of the present disclosure are not limited to the objects mentioned above, and other objects not mentioned will be clearly understood by those skilled in the art from the following description.

According to an aspect of the present disclosure, a lamp for a vehicle may include a light source unit including a plurality of light emitting units for forming different beam patterns; and an optical unit disposed in front of the light source unit for transmitting light generated from the light source unit to form a predetermined beam pattern. In particular, the plurality of light emitting units may include a first light emitting unit for forming a first beam pattern; and a second light emitting unit disposed around the first light emitting unit for forming a second beam pattern different from the first beam pattern.

The first light emitting unit and the second light emitting unit may be installed on a same substrate.

Further, one of the first light emitting unit or the second light emitting unit may be turned on during daytime, and the other of the first light emitting unit or the second light emitting unit may be turned on at night.

The first light emitting unit may be disposed closer to an optical axis of the optical unit than the second light emitting unit. A center of a light emitting region of the first light emitting unit may be disposed at or near an optical axis of the optical unit.

The second light emitting unit may comprise at least one light emitting module disposed around the first light emitting unit, and the at least one light emitting module may be disposed in at least one direction of an up-down direction, a left-right direction, or a diagonal direction with respect to the first light emitting unit.

The light emitted from the optical unit may be guided by a light guide unit, in which a guide aperture of a predetermined size is formed, and the first light emitting unit and the second light emitting unit may be disposed within a preset region having a size of about 50% or less of a size of the guide aperture.

Further, the optical unit may comprise a plurality of lenses arranged in a front-rear direction. A reflector may be further disposed in at least one of an upper end or a lower end of the plurality of lenses and between the plurality of lenses. The plurality of lenses may comprise a first lens for concentrating the light generated from the light source unit and a second lens disposed in front of the first lens to allow the light emitted from the first lens to be incident thereto. The reflector may have a rear end having a shape corresponding to the first lens, and a front end having a shape corresponding to the second lens.

At least one of the plurality of lenses may comprise a plurality of incident lenses, a plurality of emitting lenses, through which light incident to the plurality of incident lenses is emitted, and a plurality of shields disposed between an incident lens and an emitting lens corresponding to each other among the plurality of incident lenses and the plurality of emitting lenses.

According to the vehicle lamp of the present disclosure as described above, there are one or more of the following effects. When the vehicle operates during the daytime or at night, light may be irradiated from an unused lamp module among a plurality of lamp modules to eliminate unnecessary dark bands, thereby implementing a complete lit image as a whole. Effects of the present disclosure are not limited to the effects mentioned above, and other effects not mentioned will be clearly understood by those skilled in the art from the description set forth.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
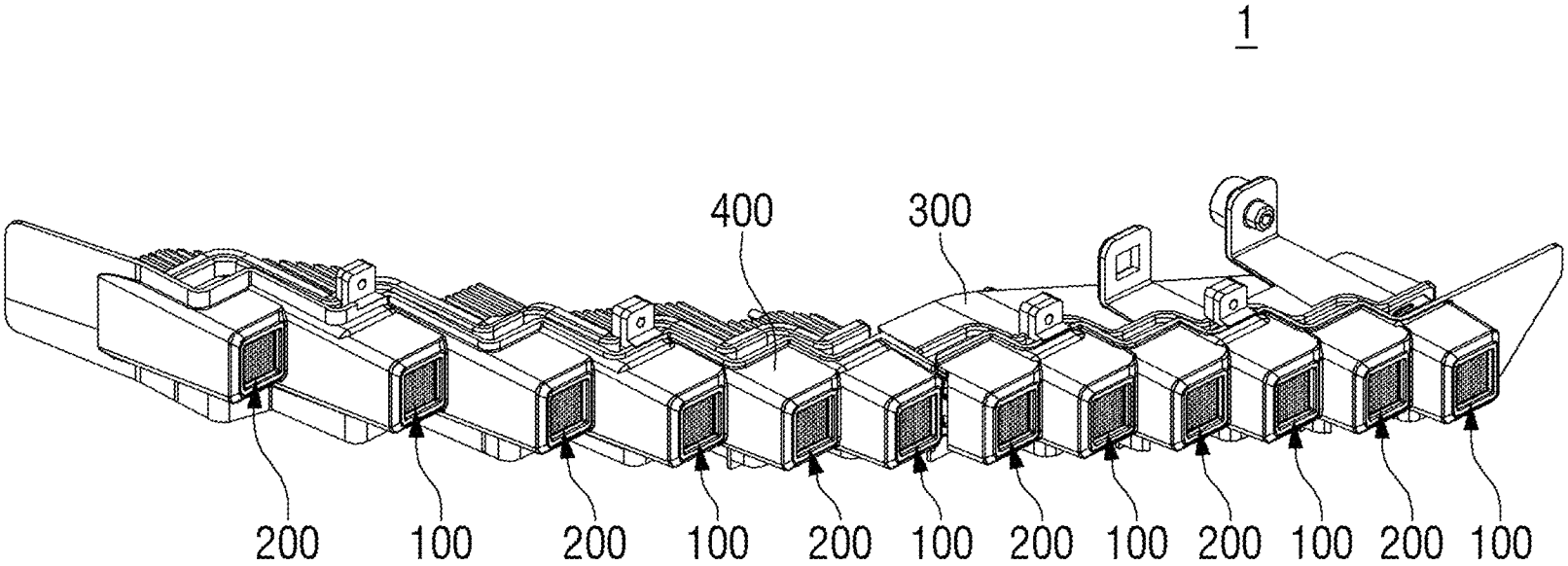
FIG. 1 is a perspective view showing a vehicle lamp according to an exemplary embodiment of the present disclosure.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the disclosure to those skilled in the art, and the present disclosure will only be defined by the appended claims. Throughout the specification, like reference numerals in the drawings denote like elements.

In some exemplary embodiments, well-known steps, structures and techniques will not be described in detail to avoid obscuring the disclosure.

The terminology used herein is for the purpose of describing particular exemplary embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Exemplary embodiments of the disclosure are described herein with reference to plan and cross-section illustrations that are schematic illustrations of idealized exemplary embodiments of the disclosure. As such, variations from the shapes of the illustrations as a result, for example, of manufacturing techniques and/or tolerances, are to be expected. Thus, exemplary embodiments of the disclosure should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for describing a vehicle lamp according to exemplary embodiments of the present disclosure.

Figure 2:
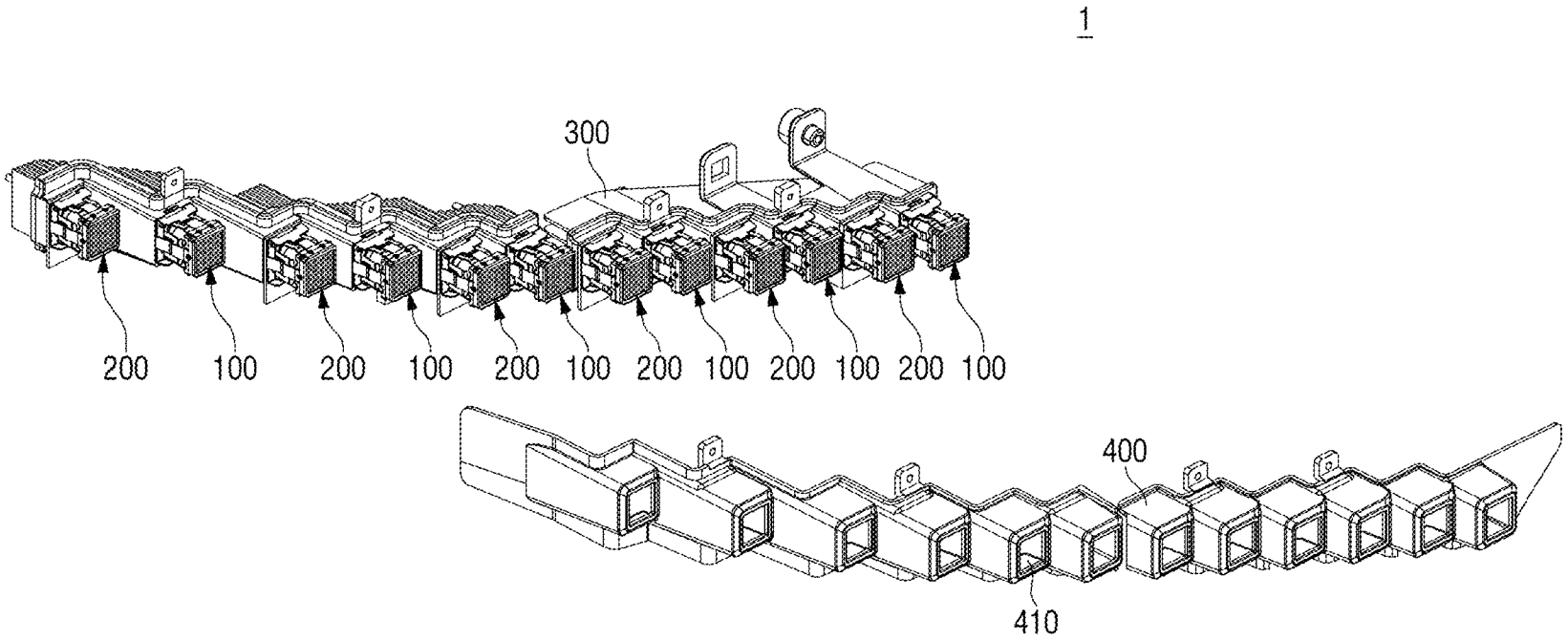
FIG. 2 is an exploded perspective view showing a vehicle lamp according to an exemplary embodiment of the present disclosure.

FIG. 1 is a perspective view illustrating a vehicle lamp according to an exemplary embodiment of the present disclosure, and FIG. 2 is an exploded perspective view illustrating a vehicle lamp according to an exemplary embodiment of the present disclosure.

Referring to FIGS. 1 and 2, a vehicle lamp 1 according to an exemplary embodiment of the present disclosure may include a plurality of lamp modules 100 and 200, and the plurality of lamp modules 100 and 200 may be mounted on a front surface of a heat dissipation unit 300. The light irradiated from at least one of the plurality of lamp modules 100 and 200 may be guided forward through a plurality of guide apertures 410 formed in a light guide unit 400 disposed in front of the heat dissipation unit 300 to form a beam pattern suitable for the function of the vehicle lamp 1 of the present disclosure.

In the exemplary embodiment of the present disclosure, the vehicle lamp 1 may be used as a function of various lamps installed in a vehicle such as a head lamp, a tail lamp, a brake lamp, a position lamp, a daytime running lamp (DRL), a turn signal lamp, a backup lamp, and a fog lamp, and the vehicle lamp 1 of the present disclosure may be used as a single function among the above-mentioned functions, or may be used as two or more functions.

In addition, in the exemplary embodiment of the present disclosure, an example where the plurality of lamp modules 100 and 200 are arranged in the left-right direction is described. However, this configuration is only an example to help the understanding of the present disclosure, and the present disclosure is not limited thereto. The plurality of lamp modules 100 and 200 may be arranged in a left-right direction, an up-down direction, or a combination thereof, depending on the layout or design considerations of the vehicle lamp 1 of the present disclosure.

The plurality of lamp modules 100 and 200 may include a first lamp module 100 that is used for a first function and a second lamp module 200 that is used for a second function, and the first lamp module 100 and the second lamp module 200 may be alternately arranged along the arrangement direction of the plurality of lamp modules 100 and 200.

The description that the first lamp module 100 is used for the first function and the second lamp module 200 is used for the second function does not necessarily mean that the first lamp module 100 and the second lamp module 200 have fixed functions, respectively. It can be understood that the first function may collectively refer to the function of the first lamp module 100 when the vehicle lamp 1 of the present disclosure comprises the first lamp module 100 and the second lamp module 200, and the second function may collectively refer to the function of the second lamp module 200 when the vehicle lamp 1 of the present disclosure comprises the first lamp module 100 and the second lamp module 200.

In particular, when all of the first lamp module 100 and the second lamp module 200 are used during the daytime and at night, respectively, all of the plurality of lamp modules 100 and 200 may be turned on to form a complete lit image. However, when any one of the first lamp module 100 or the second lamp module 200 is not used, some of the plurality of lamp modules 100 and 200 may be turned off, leading to a formation of a dark band, which may cause an incomplete lit image to be formed. As a result, exterior design or aesthetics may be deteriorated.

For example, when the first lamp module 100 is used as a function of a head lamp, and the second lamp module 200 is used as a function of a position lamp at night, all of the plurality of lamp modules 100 and 200 may be turned on to form a complete lit image. However, when the first lamp module 100 is used as a function of the head lamp and the second lamp module 200 is used as a function of the daytime running lamp during the daytime, the first lamp module 100 may be turned off, forming an incomplete lit image.

In the exemplary embodiment of the present disclosure, even when the first lamp module 100 is used as a function of a head lamp and the second lamp module 200 is used as a function of a position lamp and a daytime running lamp together during the daytime, the first lamp module 100 may be configured to irradiate light to allow a complete lit image to be still formed.

Figure 3:
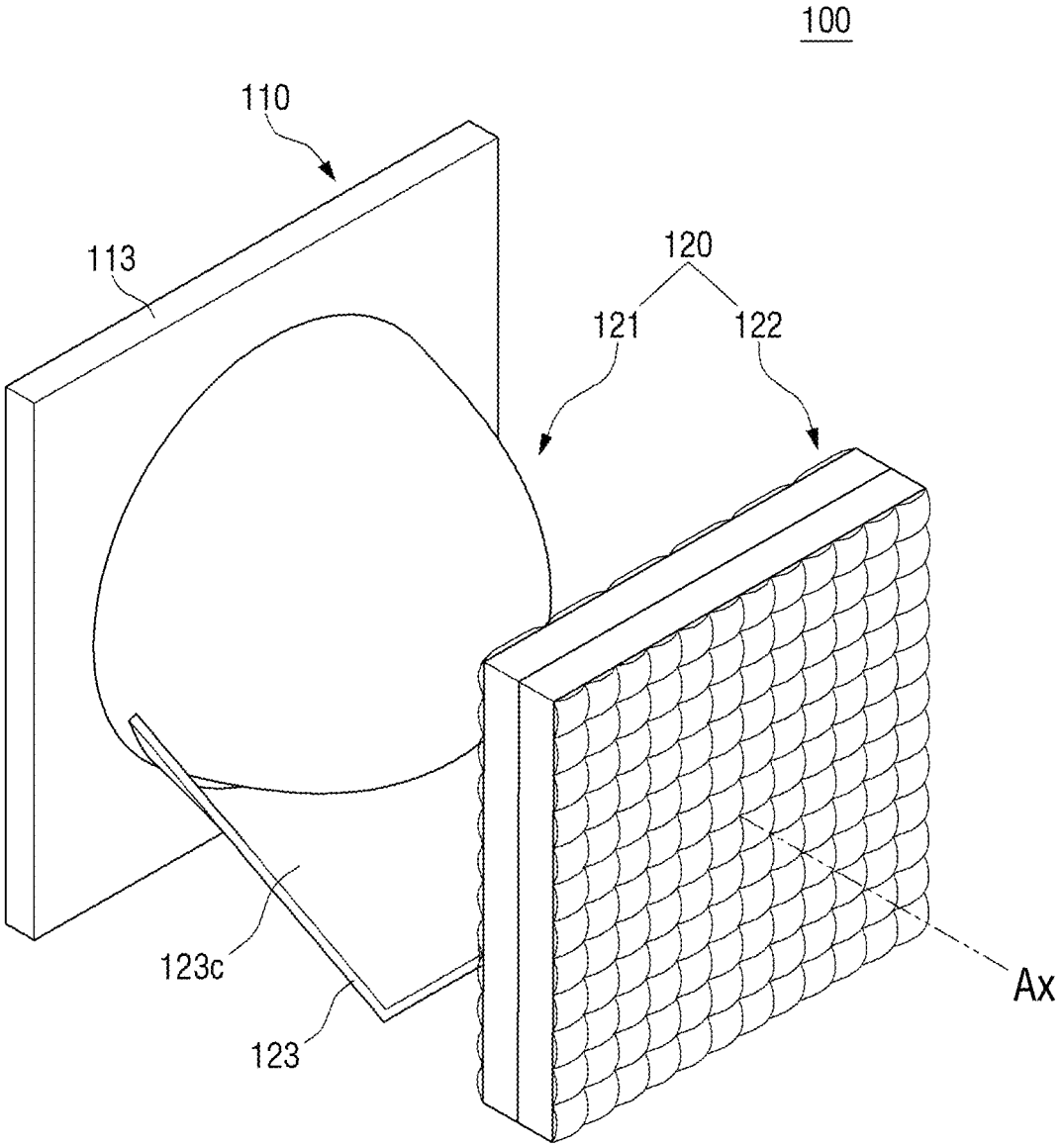
FIG. 3 is a perspective view showing a lamp module according to an exemplary embodiment of the present disclosure.
Figure 4:
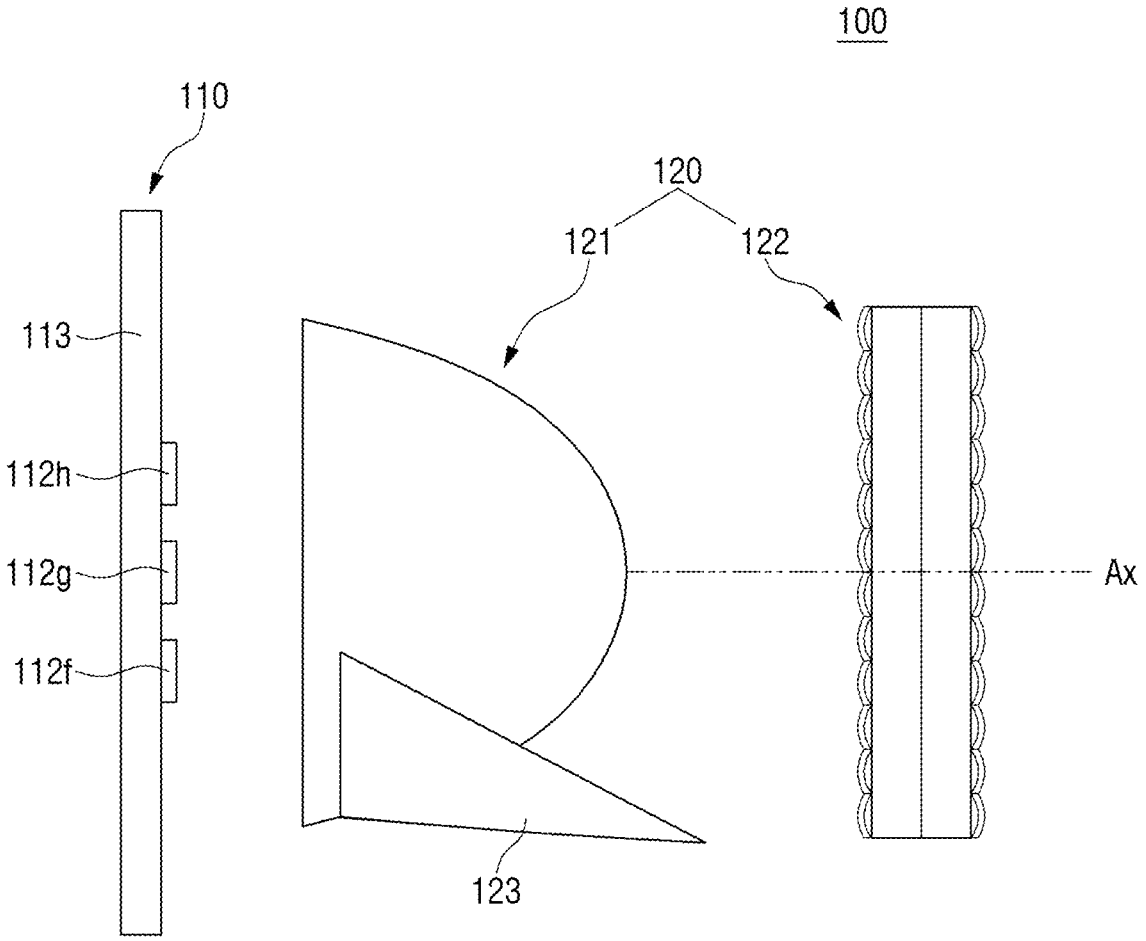
FIG. 4 is a side view showing a lamp module according to an exemplary embodiment of the present disclosure.

FIG. 3 is a perspective view showing a lamp module according to an exemplary embodiment of the present disclosure, FIG. 4 is a side view showing a lamp module according to an exemplary embodiment of the present disclosure, and FIGS. 3 and 4 are examples showing the first lamp module 100. Referring to FIGS. 3 and 4, the first lamp module 100 according to an exemplary embodiment of the present disclosure may include a light source unit 110 and an optical unit 120. The light source unit 110 may generate light having a light amount and/or color suitable for the function of the first lamp module 100.

Figure 5:
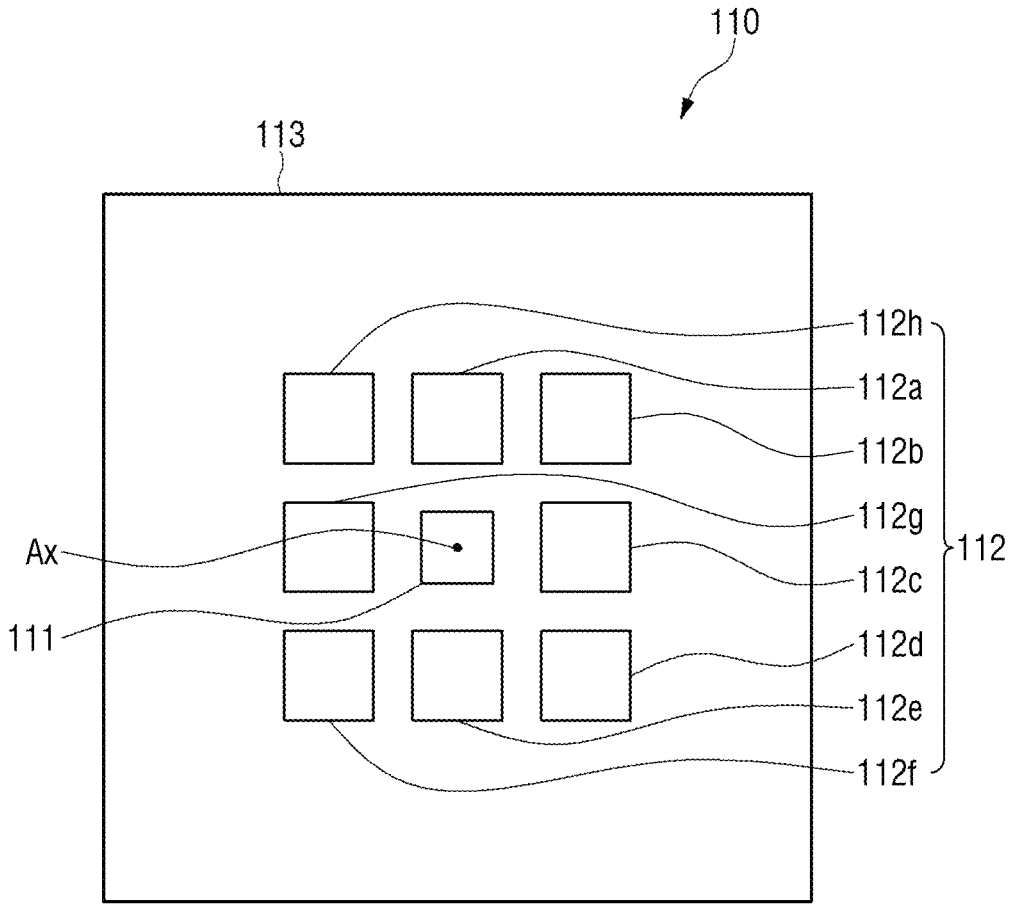
FIG. 5 is a front view illustrating a light source unit according to an exemplary embodiment of the present disclosure.

FIG. 5 is a front view illustrating a light source unit according to an exemplary embodiment of the present disclosure. Referring to FIG. 5, the light source unit 110 according to an exemplary embodiment of the present disclosure may include a plurality of light emitting units 111 and 112 installed on a substrate 113, and the plurality of light emitting units 111 and 112 may include a first light emitting unit 111 that generates light to form a first beam pattern and a second light emitting unit 112 that generates light to form a second beam pattern.

In this case, in the exemplary embodiment of the present disclosure, the plurality of light emitting units 111 and 112 may be installed on the same substrate 113. This configuration may allow the distance between the plurality of light emitting units 111 and 112 to be decreased.

Each of the plurality of light emitting units 111 and 112 may include at least one light emitting module, and in an exemplary embodiment of the present disclosure, an example where the first light emitting unit 111 includes a single light emitting module, and the second light emitting unit 112 includes a plurality of light emitting modules 112*a*, 112*b*, 112*c*, 112*d*, 112*e*, 112*f*, 112*g*, and 112*h* disposed around (e.g., encompassing or surrounding) the first light emitting unit 111 is described. However, the present disclosure is not limited thereto. The number of light emitting modules included in each of the first light emitting unit 111 and the second light emitting unit 112 may be varied based on the beam pattern to be formed by each of the first light emitting unit 111 and the second light emitting unit 112.

The first light emitting unit 111 may have a center of the light emitting region disposed at or near the optical axis Ax of the optical unit 120. This configuration may allow the first beam pattern to be used for a main function of the first lamp module 100, and greater amount of light may be generated as it approaches the center of the light emitting regions of the first light emitting unit 111.

The second light emitting unit 112 may serve as an auxiliary function of the first lamp module 100 to form a second beam pattern having a relatively low brightness compared to the first beam pattern. Accordingly, the second light emitting unit 112 may be disposed around the first light emitting unit 111, that is, to be spaced apart from the first light emitting unit 111 by a predetermined distance from the optical axis Ax of the optical unit 120.

Figure 6:
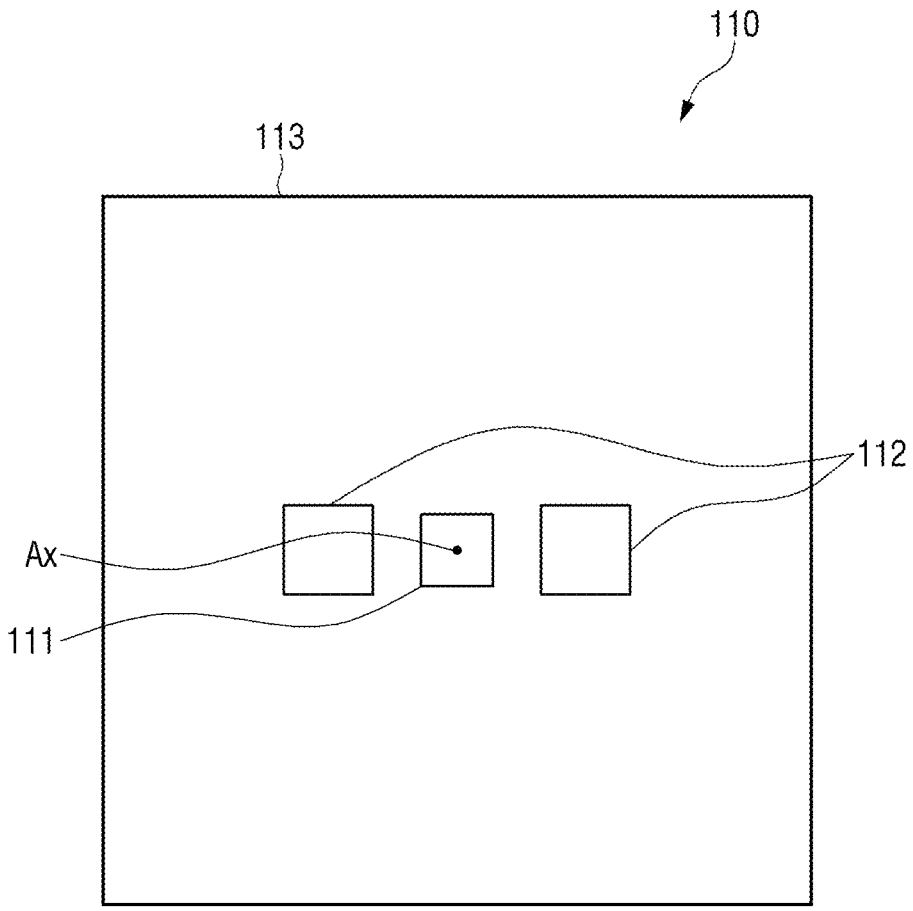
FIGS. 6 to 8 are front views showing a light source unit according to another exemplary embodiment of the present disclosure.
Figure 7:
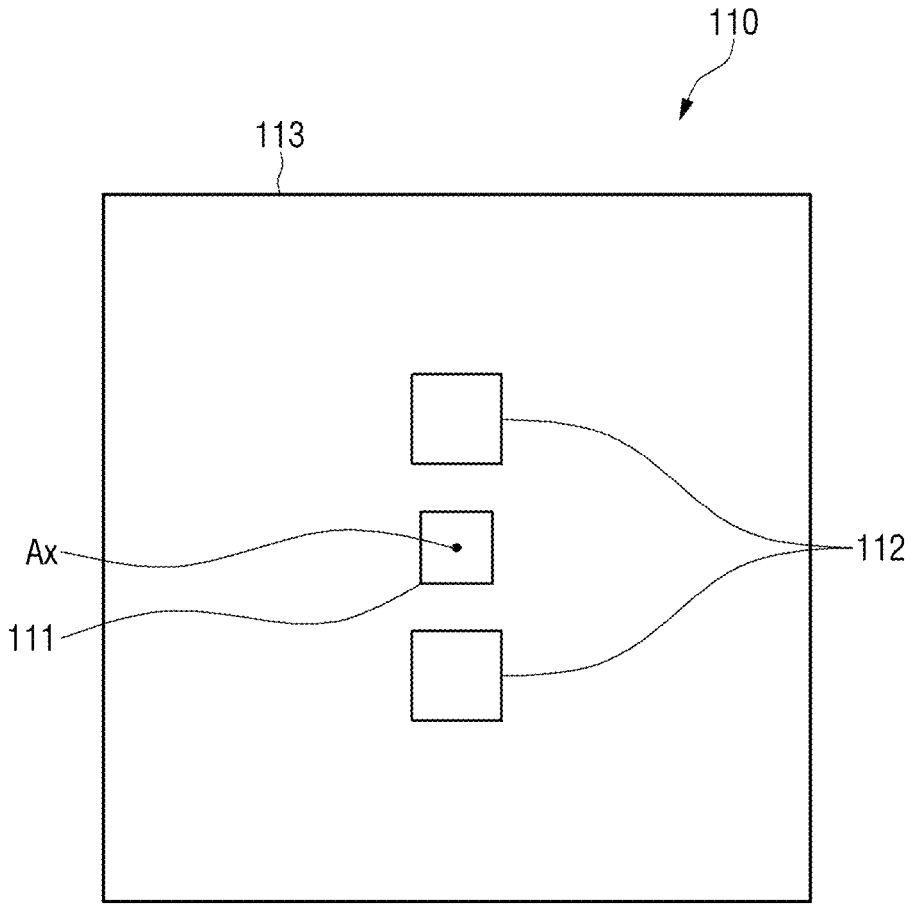
Figure 8:
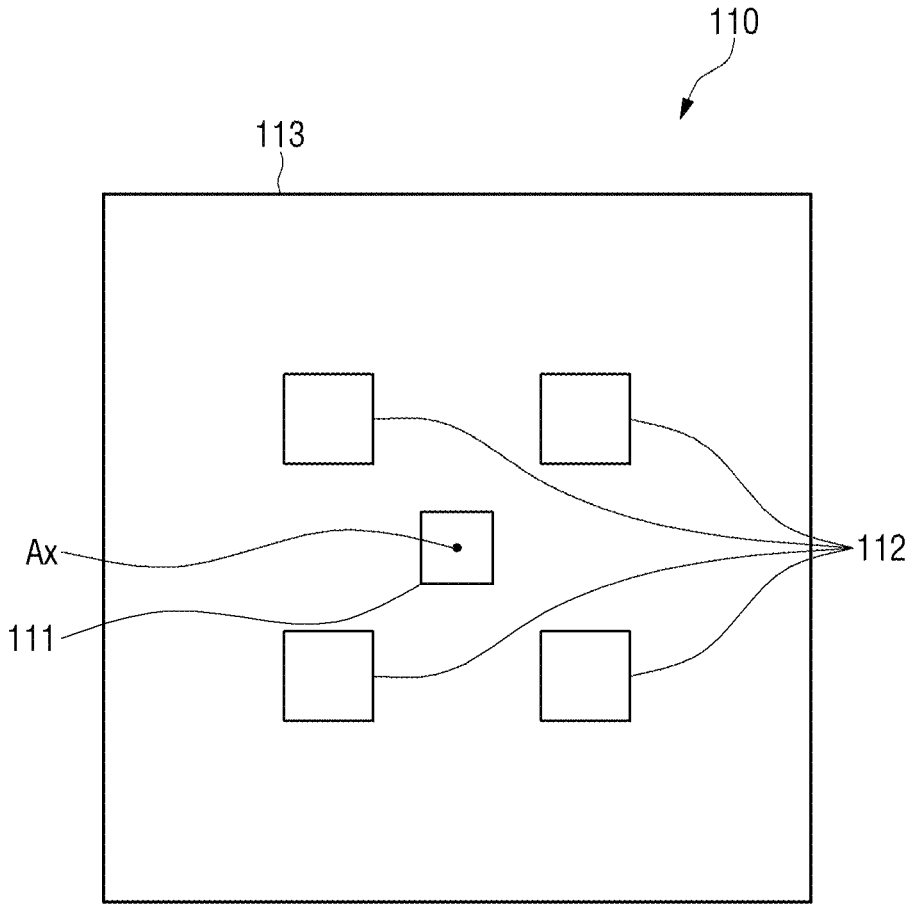

In an exemplary embodiment of the present disclosure, although an example where the second light emitting unit 112 includes eight light emitting modules 112*a*, 112*b*, 112*c*, 112*d*, 112*e*, 112*f*, 112*g*, and 112*h* surrounding the first light emitting unit 111 is described, this configuration is to allow the light to be irradiated as a whole by the optical unit 120 when the second beam pattern is formed, and the present disclosure is not limited thereto. Based on the lit image to be formed by the first lamp module 100 when the second beam pattern is formed, as shown in FIGS. 6 to 8, the second light emitting unit 112 may include at least one light emitting module disposed in the left-right direction, up-down direction, or a combination thereof, with respect to the first light emitting unit 111.

A detailed description of the lit image formed depending on the position of at least one light emitting module included in the second light emitting unit 112 with respect to the first light emitting unit 111 will be described later below.

The optical unit 120 may include at least one lens 121 and 122 disposed in front of the light source unit 110, and in an exemplary embodiment of the present disclosure, a case in which at least one lens 121 and 122 includes a first lens 121 disposed in front of the light source unit 110 and a second lens 122 disposed in front of the first lens 121 will be described as an example. Although in the exemplary embodiment of the present disclosure, an example where the optical unit 120 includes two lenses 121 and 122 is described, the present disclosure is not limited thereto. The optical unit 120 may include at least one lens based on the shape and/or size of the lit image to be formed by the vehicle lamp 1 of the present disclosure.

By way of example, an aspherical lens that concentrates the light generated from the light source unit 110 may be used as the first lens 121 to facilitate the light generated from the light source unit 110 to reach the second lens 122 with minimal loss. However, the present disclosure is not limited thereto, and a Total Internal Reflection (TIR) lens or a Fresnel lens capable of concentrating the light generated from the light source unit 110 may be used as the first lens 121.

The second lens 122 may cause a first beam pattern or a second beam pattern to be formed by the first lamp module 100 of the present disclosure, with the light incident by transmitting through the first lens 121.

Figure 9:
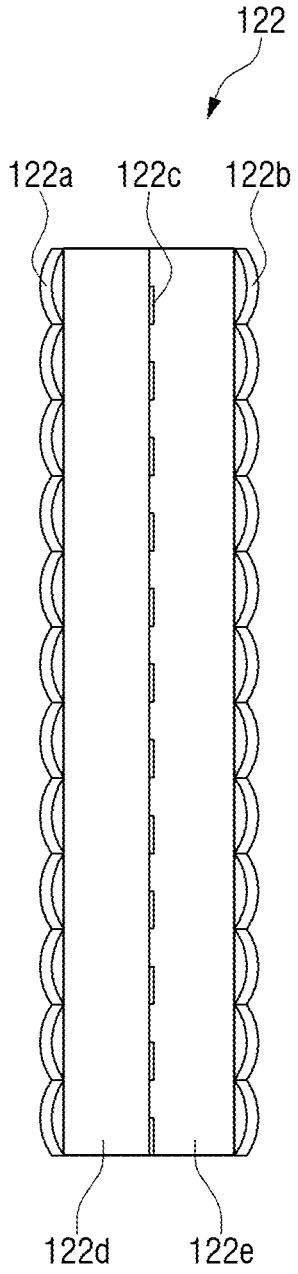
FIG. 9 is a side view showing a second lens according to an exemplary embodiment of the present disclosure.

FIG. 9 is a side view illustrating a second lens according to an exemplary embodiment of the present disclosure. Referring to FIG. 9, the second lens 122 according to the exemplary embodiment of the present disclosure may comprise a plurality of incident lenses 122*a*, to which the light that transmits through the first lens 121 may be incident, a plurality of emitting lenses 122*b* for emitting the light incident to the plurality of incident lenses 122*a*, and a plurality of shields 122*c* disposed between an incident lens and an emitting lenses corresponding to each other among the plurality of incident lenses 122*a* and the plurality of emitting lenses 122*b* for allowing the first beam pattern or the second beam pattern to have a required shape and/or size.

In the exemplary embodiment of the present disclosure, the plurality of incident lenses 122*a* may be disposed on an incident surface of the first optical member 122*d*, and the plurality of emitting lenses 122*b* may be disposed on an emitting surface of the second optical member 122*e*. The second optical member 122*e* may be disposed so that an incident surface thereof faces the emitting surface of the first optical member 122*d*. Further, the plurality of shields 122*c* may be formed on the incident surface of the second optical member 122*e* by deposition or coating. In this case, since the plurality of incident lenses 122*a* and the plurality of emitting lenses 122*b* have relatively short focal lengths, a micro lens may be used due to the advantages for miniaturization.

The light irradiated from the above-described first lamp module 100 may be guided forward by the guide aperture 410 formed in the light guide unit 400. In particular, in order for the first and second beam patterns to satisfy the required amount of light, an appropriate amount of light may be required to transmit through the guide aperture 410. Accordingly, the first light emitting unit 111 and the second light emitting unit 112 may be disposed within a proximity range set with respect to the optical axis Ax of the optical unit 120.

In other words, in regard to an auxiliary function of the first lamp module 100, the second light emitting unit 112 may be spaced apart from the first light emitting unit 111 by a predetermined distance around the first light emitting unit 111. When the first light emitting unit 111 and the second light emitting unit 112 are spaced apart by an excessive distance, the light generated from the second light emitting unit 112 may not be incident on the first lens 121, and thus light loss may occur. In this case, since the amount of light transmitting through the guide aperture 410 may decrease, there is a possibility that the second beam pattern may not satisfy the required brightness. Therefore, the second light emitting unit 112 may be required to be disposed within a predetermined proximity range from the first light emitting unit 111.

Figure 10:
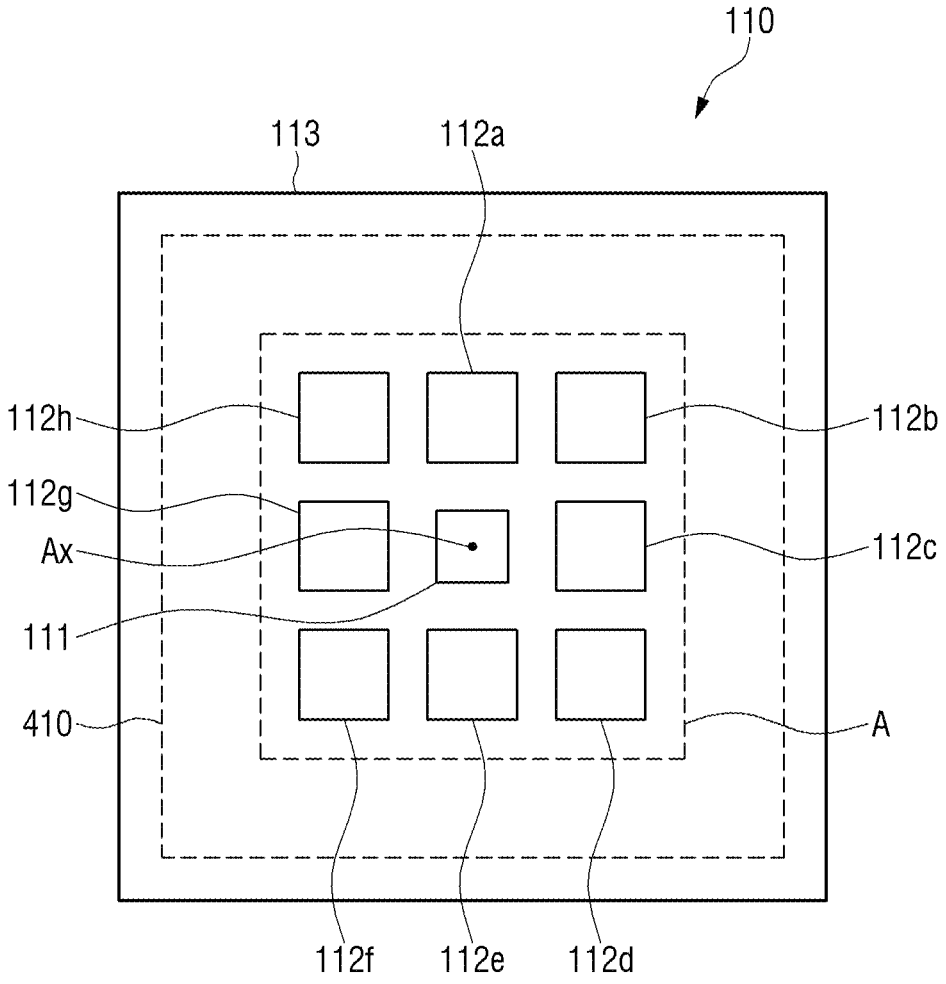
FIG. 10 is a schematic diagram illustrating a first light emitting unit and a second light emitting unit disposed within a preset region according to an exemplary embodiment of the present disclosure.

To this end, in the exemplary embodiment of the present disclosure, as shown in FIG. 10, the second light emitting unit 112 may be disposed within a preset region A having a size of about 50% with respect to a size of the guide aperture 410 centered on the optical axis Ax of the optical unit 120. The description that the second light emitting unit 112 is disposed within the preset region A may be understood as that at least one light emitting module included in the second light emitting unit 112 is disposed within the preset region A, and a distance to the second light emitting unit 112 from the first light emitting unit 111 may vary depending on the size of the preset region A.

In this case, in the exemplary embodiment of the present disclosure, the first light emitting unit 111 and the second light emitting unit 112 may be installed on the same substrate 113 such that the first light emitting unit 111 and the second light emitting unit 112 may be more comfortably disposed within the preset region A.

Figure 11:
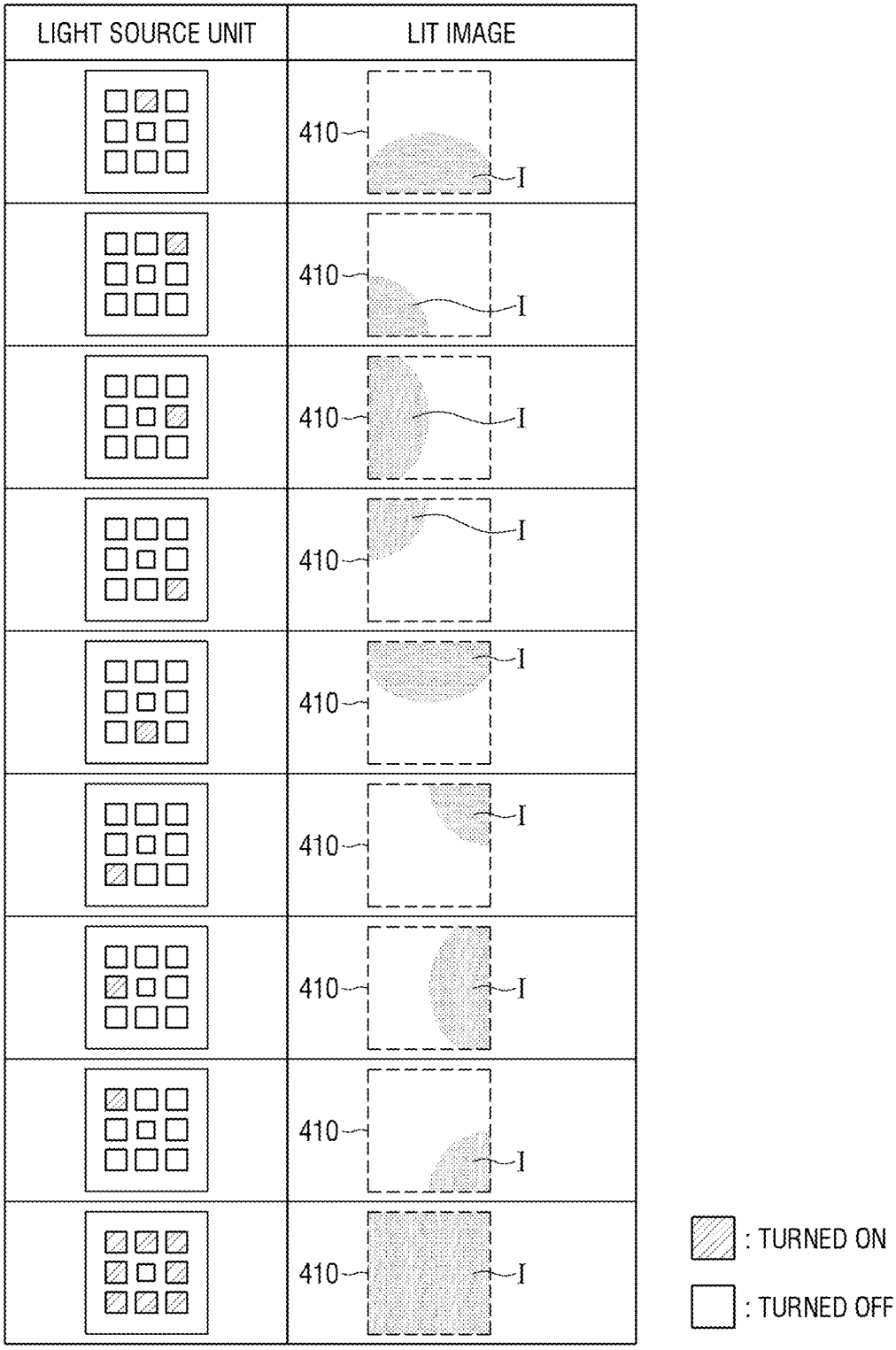
FIG. 11 shows various lit images formed by each light emitting module of a second light emitting unit according to an exemplary embodiment of the present disclosure.

FIG. 11 depicts various lit images of the second beam pattern formed by the second light emitting unit 112 as described above. FIG. 11 shows a case where eight light emitting modules 112*a*, 112*b*, 112*c*, 112*d*, 112*e*, 112*f*, 112*g*, and 112*h* are included in the second light emitting unit 112, and each light emitting module 112*a*, 112*b*, 112*c*, 112*d*, 112*e*, 112*f*, 112*g*, and 112*h* is disposed in the up-down direction, left-right direction, and diagonal direction of the first light emitting unit 111, respectively.

Referring to FIG. 11, different lit images I may be formed depending on whether each of a plurality of light emitting modules 112*a*, 112*b*, 112*c*, 112*d*, 112*e*, 112*f*, 112*g*, and 112*h* is turned on or all of the light emitting modules 112*a*, 112*b*, 112*c*, 112*d*, 112*e*, 112*f*, 112*g*, and 112*h* are turned on.

Herein, the plurality of light emitting modules 112*a*, 112*b*, 112*c*, 112*d*, 112*e*, 112*f*, 112*g*, and 112*h* in a clockwise direction from the light emitting module 112*a* disposed at an upper side in a vertical direction with respect to the first light emitting unit 111 may be referred as the first to eighth light emitting modules 112*a*, 112*b*, 112*c*, 112*d*, 112*e*, 112*f*, 112*g*, and 112*h*, respectively. A different lit image I may be formed depending on whether the first to eighth light emitting modules 112*a*, 112*b*, 112*c*, 112*d*, 112*e*, 112*f*, 112*g*, and 112*h* are turned on individually or simultaneously. In addition, the light can be generated from at least one of the first to eighth light emitting modules 112*a*, 112*b*, 112*c*, 112*d*, 112*e*, 112*f*, 112*g*, and 112*h* based on a required lit image of the second beam pattern.

According to the present disclosure, the number of the second light emitting unit 112 is not limited to eight, and depending on the required lit image, the number and/or positions of the light emitting modules included in the second light emitting unit 112 may be varied. The lit image formed by the first lamp module 100 may also be varied based on the number and/or positions of the light emitting modules included in the second light emitting unit 112.

In addition, referring to FIG. 11, the positions of the light emitting module that is turned on among the first to eighth light emitting modules 112*a*, 112*b*, 112*c*, 112*d*, 112*e*, 112*f*, 112*g*, and 112*h* and the lit image corresponding thereto are shown as though they are opposite to each other with respect to the optical axis Ax of the optical unit 120. This is because when an aspherical lens is used as the first lens 121, the image formed by the light transmitting through the aspherical lens may appear in a reverse image with respect to the position of the light emitting module. The positions of the light emitting module that is turned on and the lit image formed accordingly may be in the same direction with respect to the optical axis Ax of the optical unit 120 depending on the type of the first lens 121 used.

Referring back to FIGS. 3 and 4, the optical unit 120 may include a reflector 123 disposed between the first lens 121 and the second lens 122 for reflecting at least a portion of the light emitted from the first lens 121. In the exemplary embodiment of the present disclosure, the rear end of the reflector 123 may be disposed near the lower end of the first lens 121 and the front end may be disposed near the lower end of the second lens 122, but this is only an example for helping understanding of the present disclosure. The reflector 123 may be disposed in at least one of upper or lower ends of the first lens 121 and the second lens 122.

The reflector 123 may serve to smoothly change the brightness of the boundary line of the lit image formed by the first lamp module 100 to allow the boundary line of the lit image to be expanded, and thus the lit image formed by the second light emitting unit 112 may be expanded or diffused.

Figure 12:
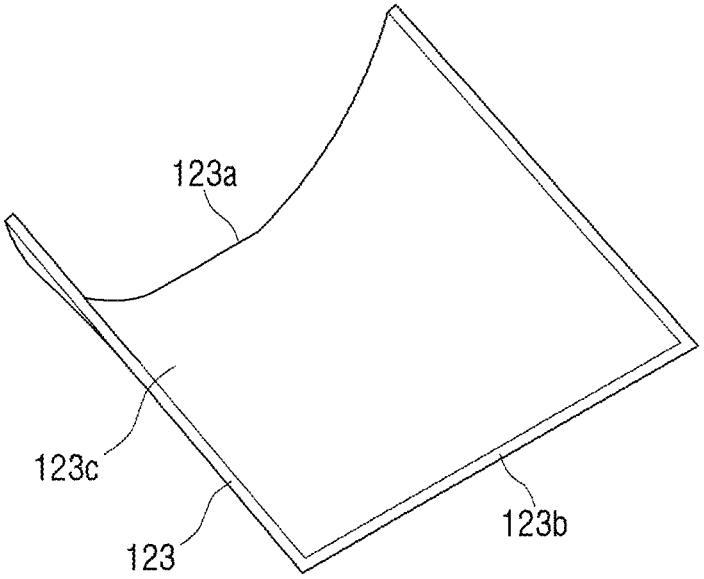
FIG. 12 is a perspective view illustrating a reflector according to an exemplary embodiment of the present disclosure.

FIG. 12 is a perspective view illustrating a reflector according to an exemplary embodiment of the present disclosure. Referring to FIG. 12, the reflector 123 according to the exemplary embodiment of the present disclosure may be formed so that the rear end 123*a* has a shape corresponding to the first lens 121 disposed at the rear of the reflector 123, and the front end 123*b* has a shape corresponding to the second lens 122 disposed in front of the reflector 123.

In the exemplary embodiment of the present disclosure, since an aspherical lens is described as an example for the first lens 121, the rear end 123*a* of the reflector 123 may be formed to have a curved shape according to the shape of the emitting surface of the aspherical lens. Further, since, as the second lens 122, the plurality of incident lenses 122*a* are arranged to have a planar shape substantially perpendicular to the optical axis Ax of the optical unit 120, the front end 123*b* of the reflector 123 may have a linear shape (e.g., a flat shape). However, this configuration is only an example for helping understanding of the present disclosure, and the present disclosure is not limited thereto. Depending on the shapes of the first lens 121 and the second lens 122, the shape of the rear end 123*a* and the front end 123*b* of the reflector 123 may be varied accordingly.

Further, a reflective surface 123*c* of the reflector 123 may have a concavely curved shape with respect to the optical axis Ax so that the light reflected by the reflector 123 may be incident on the second lens 122. The reflective surface 123*c* may be formed by depositing or coating a material having a high reflectivity, such as aluminum or chrome, or may be made of a white material having a relatively high reflectivity.

Figure 13:
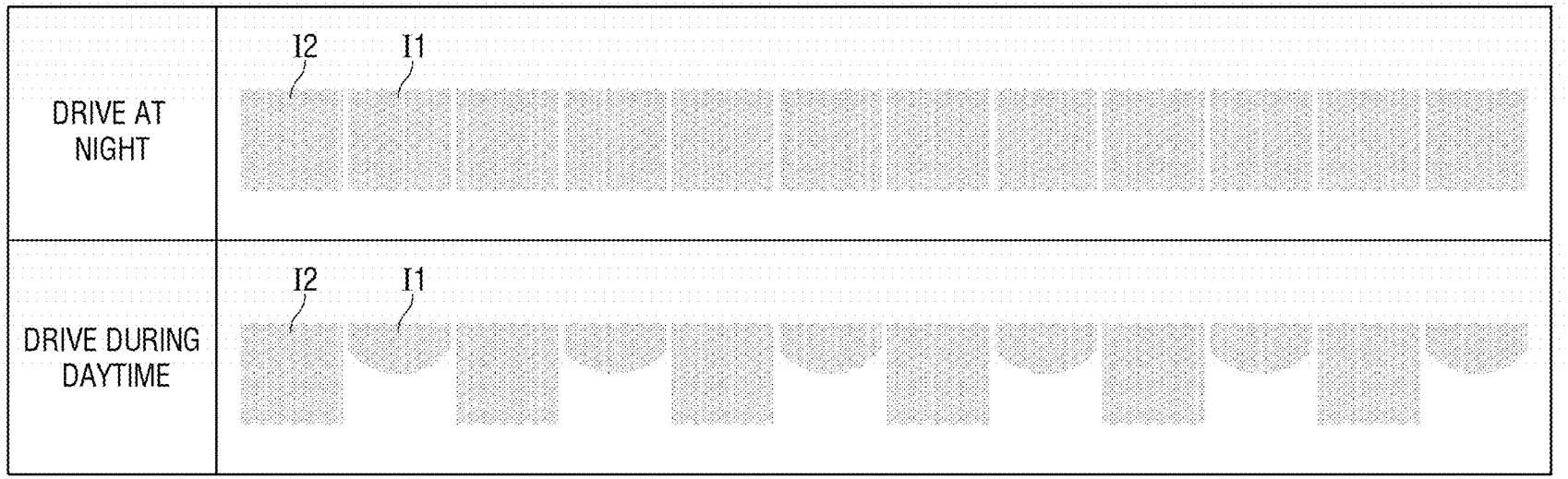
FIG. 13 is a schematic view showing a lit image formed by a vehicle lamp according to an exemplary embodiment of the present disclosure.

FIG. 13 illustrates a lit image formed by a vehicle lamp according to an exemplary embodiment of the present disclosure. Referring to FIG. 13, in the vehicle lamp 1 of the present disclosure, when the vehicle operates at night, the first light emitting unit 111 of the first lamp module 100 may be turned on to provide a functionality as a head lamp, and the second lamp module 200 may be used to provide a functionality as a position lamp. Consequently, the first lit image I1 by the first lamp module 100 and the lit image I2 by the second lamp module 200 may be alternately formed to create a complete lit image as a whole.

When the vehicle operates during the daytime, the second light emitting unit 112 of the first lamp module 100 may be turned on for a functionality to assist the daytime running lamp (i.e., an auxiliary function), and the second lamp module 200 may be used for a functionality of the daytime running lamp. Consequently, the first lit image I1 by the first lamp module 100 and the lit image I2 by the second lamp module 200 may be alternately formed to also create a substantially complete lit image as a whole, similar to the case where the vehicle operates at night.

More specifically, FIG. 13 shows an example where only the fifth light emitting module 112*e* is turned on among the above-described first to eighth light emitting modules 112*a*, 112*b*, 112*c*, 112*d*, 112*e*, 112*f*, 112*g*, and 112*h* when the first lamp module 100 is used for a functionality to assist the daytime running lamp. However, the present disclosure is not limited thereto. When the first lamp module 100 is used for assisting the daytime running lamp, the shape of the lit image formed by the first lamp module 100 may be varied based on the light emitting module to be turned on among the first to eighth light emitting modules 112*a*, 112*b*, 112*c*, 112*d*, 112*e*, 112*f*, 112*g*, and 112*h* depending on the desired lit image.

In the exemplary embodiment of the present disclosure, at night, the first light emitting unit 111 may be turned on and the second light emitting unit 112 may be turned off, and during the daytime, the first light emitting unit 111 may be turned off and the second light emitting part 112 may be turned on. However, this is only an example for helping understanding of the present disclosure, and the present disclosure is not limited thereto. Based on the function of the first lamp module 100, any one of the first light emitting unit 111 or the second light emitting unit 100 may be turned on during the daytime, and the other may be turned on at night.

As described above, in the vehicle lamp 1 of the present disclosure, the first lamp module 100 and the second lamp module 200 may be alternately arranged, and when the vehicle operates at night and during the daytime, a lit image may be formed by the first lamp module 100 and the second lamp module 200 so that an incomplete lit image may be prevented from being formed by some of the first lamp module 100 and the second lamp module 200 that are turned off. Therefore, deterioration of exterior design or aesthetics may be prevented.

In concluding the detailed description, those skilled in the art will appreciate that many variations and modifications can be made to the exemplary embodiments without substantially departing from the principles of the present disclosure. Therefore, the disclosed exemplary embodiments of the disclosure are used in a generic and descriptive sense only and not for purposes of limitation.

What is claimed is:

1. A lamp for a vehicle comprising:

a light source unit including a plurality of light emitting units for forming different beam patterns;

an optical unit disposed in front of the light source unit for transmitting light generated from the light source unit to form a predetermined beam pattern, wherein the optical unit comprises a plurality of lenses arranged in a front-rear direction; and a reflector disposed in at least one of an upper end or a lower end of the plurality of lenses and between the plurality of lenses, wherein the plurality of light emitting units comprise, a first light emitting unit for forming a first beam pattern; and a second light emitting unit disposed around the first light emitting unit for forming a second beam pattern different from the first beam pattern, wherein the first light emitting unit is disposed closer to an optical axis of the optical unit than the second light emitting unit, and wherein a light amount generated by the first light emitting unit is greater than a light amount generated by the second light emitting unit.

2. The lamp for a vehicle of claim 1, wherein the first light emitting unit and the second light emitting unit are installed on a same substrate.

3. The lamp for a vehicle of claim 1, wherein the first light emitting unit constitutes a head lamp, and the second light emitting unit constitutes a position lamp.

4. The lamp for a vehicle of claim 1, wherein the second light emitting unit constitutes a daytime running lamp.

5. The lamp for a vehicle of claim 1, wherein a center of a light emitting region of the first light emitting unit is disposed at or near an optical axis of the optical unit.

6. The lamp for a vehicle of claim 1, wherein the second light emitting unit comprises at least one light emitting module disposed around the first light emitting unit, and wherein the at least one light emitting module is disposed in at least one direction of an up-down direction, a left-right direction, or a diagonal direction with respect to the first light emitting unit.

7. The lamp for a vehicle of claim 1, wherein the light emitted from the optical unit is guided by a light guide unit, in which a guide aperture of a predetermined size is formed, and wherein the first light emitting unit and the second light emitting unit are disposed within a preset region having a size of about 50% or less of a size of the guide aperture.

8. The lamp for a vehicle of claim 1, wherein the plurality of lenses comprise a first lens for concentrating the light generated from the light source unit and a second lens disposed in front of the first lens to allow the light emitted from the first lens to be incident thereto, and wherein the reflector has a rear end having a shape corresponding to the first lens, and a front end having a shape corresponding to the second lens.

9. The lamp for a vehicle of claim 1, wherein at least one of the plurality of lenses comprises:

a plurality of incident lenses;

a plurality of emitting lenses, through which light incident to the plurality of incident lenses is emitted; and a plurality of shields disposed between an incident lens and an emitting lens corresponding to each other among the plurality of incident lenses and the plurality of emitting lenses.

10. A vehicle lamp capable of operating in at least a first operation mode and a second operation mode, the vehicle lamp comprising:

one or more first lamp modules; and one or more second lamp modules, wherein each of the first lamp modules and the second lamp modules comprises:

a light source unit including a first light emitting unit and a second light emitting unit to generate light; and an optical unit disposed in front of the light source unit for transmitting the light generated from the light source unit to form a predetermined beam pattern, wherein the first light emitting unit is disposed closer to an optical axis of the optical unit than the second light emitting unit, wherein, in the first operation mode, the first light emitting unit of the first lamp modules is turned on, and the second lamp modules are turned on, whereby all of the first lamp modules and the second lamp modules are lit to produce a first beam pattern, wherein, in the second operation mode, the second light emitting unit of the first lamp modules is turned on, and the second lamp modules are turned on, whereby all of the first lamp modules and the second lamp modules are lit to produce a second beam pattern, which is different from the first beam pattern, wherein, in the first operation mode, the first lamp modules function as a head lamp, and the second lamp modules function as a position lamp, and wherein, in the second operation mode, the second lamp modules function as a daytime running lamp, and the first lamp modules perform an auxiliary function to assist the daytime running lamp.

11. The vehicle lamp of claim 10, wherein the first lamp modules and the second lamp modules are alternatively arranged adjacent to one another.

* * * * *